US006302274B1

(12) United States Patent
Ridgeway

(10) Patent No.: US 6,302,274 B1
(45) Date of Patent: Oct. 16, 2001

(54) SUSPENSION AND RETENTION PACKAGING STRUCTURES AND METHODS FOR FORMING SAME

(75) Inventor: Devin C. Ridgeway, Chula Vista, CA (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 0 days.

(21) Appl. No.: 09/452,264

(22) Filed: Dec. 1, 1999

(51) Int. Cl.[7] ..... B65D 81/07
(52) U.S. Cl. ..... 206/583; 229/189
(58) Field of Search ..... 206/583, 591, 206/594, 775–782; 229/186–189, 162

(56) References Cited

U.S. PATENT DOCUMENTS

| | | | | |
|---|---|---|---|---|
| 308,190 | | 11/1884 | Munson . | |
| 340,915 | | 4/1886 | Hurd . | |
| 738,516 | | 9/1903 | Beers . | |
| 1,422,540 | | 7/1922 | Christensen . | |
| 1,443,055 | | 1/1923 | Sutherland . | |
| 1,457,641 | | 6/1923 | Stubbs . | |
| 1,563,907 | | 12/1925 | Koff . | |
| 1,736,720 | | 11/1929 | Myers . | |
| 1,926,366 | | 9/1933 | Bergstein | 229/31 |
| 1,985,778 | | 12/1934 | Himes | 229/31 |
| 1,993,323 | | 3/1935 | Frankenstein | 229/41 |
| 2,031,381 | | 2/1936 | McCallum | 206/47 |
| 2,334,902 | | 11/1943 | Buttery | 229/32 |
| 2,637,483 | | 5/1953 | Shapiro | 229/31 |
| 2,707,553 | | 5/1955 | Yount | 206/65 |
| 2,777,628 | * | 1/1957 | Conescu | 229/186 |
| 2,844,473 | | 7/1958 | Seiferth et al. | 99/174 |
| 2,865,549 | | 12/1958 | Inman | 229/16 |
| 2,889,103 | | 6/1959 | Kuchenbecker | 229/45 |
| 3,089,590 | | 5/1963 | Mell | 206/78 |
| 3,236,434 | * | 2/1966 | Taddeau | 229/186 |
| 3,424,306 | | 1/1969 | Munck | 206/65 |
| 3,437,198 | | 4/1969 | Van Saun et al. | 206/65 |
| 3,507,383 | | 4/1970 | Rorer | 206/46 |

(List continued on next page.)

FOREIGN PATENT DOCUMENTS

| | | |
|---|---|---|
| 691904 | 8/1964 | (CA) . |
| 49-59982 | 5/1974 | (JP) . |
| 49-77087 | 7/1974 | (JP) . |
| 50-88376 | 7/1975 | (JP) . |
| 50-102778 | 8/1975 | (JP) . |
| 50-107583 | 9/1975 | (JP) . |
| 57-177969 | 11/1982 | (JP) . |
| 3-100158 | 10/1991 | (JP) . |

OTHER PUBLICATIONS

Sealed Air Corporation (US) Retention Package, photographs 1–3, date unknown.

*Primary Examiner*—Jim Foster

(57) ABSTRACT

A packaging structure for holding an article within an outer box includes a pair of side legs and a pair of end legs defining a main portion having a window opening, and a flexible web extending across the window opening. End portions are connected to first ends of the side legs along first fold lines and to second ends of the side legs along second fold lines. Each end portion includes an intermediate fold line at an oblique angle relative to the first and second fold lines, dividing the end portions into first regions adjacent the ends of the side legs, and second regions remote therefrom. The end portions are connected in the second regions to the end legs to form the packaging structure into an intermediate folded structure. The packaging structure may be converted from the intermediate folded structure to a use condition by pulling the side legs away from the main portion, whereby the end legs fold in a direction toward the main portion, or by folding the end legs in a direction toward the main portion, whereby the side legs move in a direction away from the main portion.

3 Claims, 10 Drawing Sheets

U.S. PATENT DOCUMENTS

| | | | | |
|---|---|---|---|---|
| 3,540,579 | | 11/1970 | Hellstrom | 206/56 |
| 3,658,234 | | 4/1972 | Deckys | 229/31 FS |
| 3,669,337 | | 6/1972 | Struble | 229/14 BA |
| 3,679,120 | | 7/1972 | Rubin | 229/23 BT |
| 3,704,824 | | 12/1972 | Croley | 229/32 |
| 3,718,275 | | 2/1973 | Willinger | 229/14 C |
| 3,891,090 | | 6/1975 | Spiegel et al. | 206/478 |
| 3,905,474 | | 9/1975 | Haibara | 206/45.33 |
| 3,916,030 | | 10/1975 | Bard et al. | 426/113 |
| 3,966,046 | | 6/1976 | Deutschlander | 206/445 |
| 4,030,603 | | 6/1977 | Angell | 206/521 |
| 4,182,224 | | 1/1980 | Dutcher | 93/39 R |
| 4,189,088 | * | 2/1980 | Rappolt et al. | 229/186 |
| 4,211,324 | | 7/1980 | Ohlbach | 206/328 |
| 4,285,432 | | 8/1981 | de Villers et al. | 206/591 |
| 4,306,653 | | 12/1981 | Fales | 206/326 |
| 4,307,804 | | 12/1981 | Benham | 206/45.33 |
| 4,308,953 | | 1/1982 | Cohen | 206/334 |
| 4,324,357 | | 4/1982 | Murkowski | 229/37 E |
| 4,494,689 | | 1/1985 | Ilitch | 229/30 |
| 4,606,459 | | 8/1986 | Luray | 206/583 |
| 4,606,460 | | 8/1986 | Luray | 206/583 |
| 4,632,301 | | 12/1986 | Slack | 206/292 |
| 4,677,809 | | 7/1987 | Long et al. | 53/427 |
| 4,757,900 | | 7/1988 | Misset et al. | 206/497 |
| 4,792,042 | | 12/1988 | Koehn et al. | 206/328 |
| 4,795,085 | | 1/1989 | Wein | 229/41 B |
| 4,852,743 | | 8/1989 | Ridgeway | 206/583 |
| 4,915,222 | | 4/1990 | Reidinger et al. | 206/328 |
| 4,923,065 | | 5/1990 | Ridgeway | 206/583 |
| 5,056,665 | | 10/1991 | Boecker et al. | 206/583 |
| 5,071,009 | | 12/1991 | Ridgeway | 206/586 |
| 5,086,925 | | 2/1992 | Coalier et al. | 206/497 |
| 5,251,760 | | 10/1993 | Smith et al. | 206/583 |
| 5,259,507 | | 11/1993 | Smith | 206/583 |
| 5,295,580 | | 3/1994 | Hicks | 206/588 |
| 5,323,896 | | 6/1994 | Jones | 206/223 |
| 5,388,701 | | 2/1995 | Ridgeway | 206/583 |
| 5,678,695 | | 10/1997 | Ridgeway et al. | 206/583 |
| 5,694,744 | | 12/1997 | Jones | 53/449 |
| 5,839,652 | | 11/1998 | Ben-Haim | 229/240 |
| 5,855,317 | | 1/1999 | Dalrymple | 229/186 |
| 5,893,462 | | 4/1999 | Ridgeway | 206/583 |
| 5,894,932 | | 4/1999 | Harding et al. | 206/583 |
| 5,954,263 | | 9/1999 | Posson | 229/186 |
| 5,967,327 | | 10/1999 | Jones | 206/583 |
| 6,010,006 | | 1/2000 | Ridgeway et al. | 206/583 |

* cited by examiner

SUSPENSION AND RETENTION PACKAGING STRUCTURES AND METHODS FOR FORMING SAME

FIELD OF THE INVENTION

The present invention relates to packaging structures, and more particularly to packaging structures in which an article is held in place within an outer container by at least one flexible film. More particularly, the present invention is directed to improved methods for forming such packaging structures, and to the structures produced by these methods.

BACKGROUND OF THE INVENTION

Protective packaging structures are often used when an article to be transported requires protection from physical shock, dust, dirt and other contaminants. For or example, when shipping articles which may be relatively fragile, it is often desirable to package the article inside a box to protect the article from physical impacts to the box which may occur during loading, transit and unloading. In addition, when shipping sensitive electronic articles, such as computer components, it is often desirable to protect those components from dust and dirt. Aside from the shipping box itself, some additional structures are ordinarily needed to prevent the article from being damaged by uncontrolled movement within the box. Such additional structures have included paper or plastic dunnage, molded plastic foams and foam-filled cushions, among others.

One useful form of packaging for especially fragile articles is frequently referred to as suspension packaging, examples of which are disclosed in U.S. Pat. No. 4,852,743 to Louis H. Ridgeway and U.S. Pat. No. 5,388,701 to Devin C. Ridgeway. In suspension packaging, the article is suspended between two confronting sheets of plastic film. The sheets are usually attached to frames which are sized to fit securely within a selected size box. The frame includes side and end legs which may be folded away from the film so as to space the film from the top or bottom of the box. The fact that the article is not in contact with any substantially rigid surfaces protects it from physical shock.

An alternative to suspension packaging is often referred to as retention packaging. One version of retention packaging utilizes a frame including a rigid border extending around the entire periphery of a window opening, and side legs and end legs foldably connected to and supporting the border. A flexible film is connected to the underside of the border so that it extends across the window opening. An article to be packaged is placed on the film, and a series of four flaps connected to the four sides of the border are folded over the article to hold the article in place against the film. In a variant of this package, disclosed in U.S. Pat. No. 5,893,462 to Devin C. Ridgeway, the rigid border is eliminated, the flexible film is connected to the folding side legs, and only two flaps are foldably connected to the side legs to hold the article in place against the film. This variant provides increased structural rigidity while reducing the overall size of the package.

All of the foregoing packaging structures require side legs and end legs to be folded away from the film for the purpose of supporting the film at a position spaced from the top and bottom of the box. This is a time-consuming and cumbersome process which, when packaging many thousands of articles, may have a substantial impact on employee fatigue and overall shipping costs.

There therefore exists a need for packaging structures which are easier and less time consuming to form than prior art packaging structures. Preferably, such structures will have an efficient design enabling the structures to be shipped in a flat configuration and readily converted to a folded configuration without sacrificing the strength of the packaging structure so as to risk damage to the articles packaged therein.

SUMMARY OF THE INVENTION

The present invention addresses these needs.

One aspect of the present invention provides packaging structures adapted for insertion into an outer box. One embodiment of the packaging structure includes a panel having a front surface and a rear surface, a first pair of fold lines spaced from opposite side edges of the panel to define a pair of folding side legs, each of the side legs including a first end adjacent one of the end legs and a second end adjacent another one of the end legs, and a second pair of fold lines spaced from opposite end edges of the panel to define a pair of folding end legs. A first end portion may be connected to the first end of one of the side legs along a first fold line, the first end portion including a first intermediate fold line disposed at an oblique angle relative to the first fold line to divide the first end portion into a first region adjacent the first fold line and a second region. A second end portion may be connected to the second end of one of the side legs along a second fold line, the second end portion including a second intermediate fold line disposed at an oblique angle relative to the second fold line to divide the second end portion into a first region adjacent the second fold line and a second region. The folding side legs may be folded against the rear surface of the panel with the first end portion secured in the second region to one of the end legs and the second end portion secured in the second region to another one of the end legs to define an intermediate folded structure in which the folding end legs are substantially coplanar with one another. The panel is foldable from the intermediate folded structure to a use condition in which the side legs and the end legs project away from the rear surface of the panel.

In preferred embodiments, the side legs and the end legs may delimit a main portion of the panel having a window opening, and the packaging structure may further include a flexible film material connected to the panel so as to extend across the window opening. In highly preferred embodiments, the packaging structure may further include a series of foldable members, some of the foldable members being foldably connected at one edge to the side legs, and others of the foldable members being foldably connected at one edge to the end legs. In other embodiments, the packaging structure may include at least one flap foldably connected at one edge to one of the side legs for movement between an open position remote from the window opening and a closed position adjacent the window opening.

The packaging structure described above may be converted from the intermediate folded structure to the use condition by pulling the side legs in a direction away from the rear surface of the panel, whereby the end legs are folded along the end fold lines in a direction toward the rear surface of the panel. Alternatively, the end legs may be folded in a direction toward the rear surface of the panel, whereby the side legs are folded along the side fold lines in a direction away from the rear surface of the panel.

A packaging structure in accordance with another embodiment of the present invention includes a pair of end legs, each of the end legs having a front surface and a rear surface, and a pair of side legs, each of the side legs including first and second ends. A first end portion may be connected to the first end of each of the side legs along a first fold line, the first end portion including a front surface, a rear surface and a first intermediate fold line disposed at an oblique angle relative to the first fold line to divide the first end portion into a first region adjacent the first fold line and a second region. A second end portion may be connected to the second end of each of the side legs along a second fold line, the second end portion including a front surface, a rear surface and a second intermediate fold line disposed at an oblique angle relative to the second fold line to divide the second end portion into a first region adjacent the second fold line and a second region. The front surfaces of the first end portions may be secured in the second regions to the rear surface of one of the end legs and the front surfaces of the second end portions may be secured in the second regions to the rear surface of the other end leg to define a preform. The preform is foldable from an intermediate folded structure in which the end legs lie substantially in a plane and the side legs lie substantially parallel to the plane, to a use condition in which the side legs and the end legs are transverse to the plane.

The foregoing packaging structure may be converted from the intermediate folded structure to the use condition by moving the free edges of one of the pair of end legs and the pair of side legs in a direction away from the plane, whereby the free edges of the other one of the pair of end legs and the pair of side legs move in a direction away from the plane.

Another aspect of the present invention provides a packaging assembly for holding an article. The packaging assembly includes a box and at least one of the packaging structures described above assembled in the box in the use condition. In preferred embodiments, the packaging assembly may further include another packaging structure assembled in the box. The another packaging structure may include a panel having a front surface and a rear surface, a main portion having a window opening, a pair of fold lines spaced from opposite edges of the panel to define a pair of folding legs, and a flexible film material connected to the panel so as to extend across the window opening. The packaging structures may be assembled in the box so that the film material in one packaging structure confronts the film material in the other packaging structure.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS

In the following are described multiple embodiments of the packaging structure of the present invention. In each embodiment, the packaging structure includes a structural frame and a flexible support web connected in selected regions thereto. The frame may be formed from any substantially rigid, lightweight foldable material, such as cardboard, plastic, compressed foam, paperboard, corrugated cardboard and the like. A particularly preferred material is a single wall corrugated cardboard such as B-flute or E-flute corrugated cardboard. In accordance with techniques which are generally known in the packaging art, a single panel or blank of such material may be cut and folded according to predetermined patterns to yield frames having a desired size and structural features for a particular application.

The support web may be formed from any flexible material which can cradle and support a packaged article without damaging it, and may include netting, spandex, Lycra™, rubber and other resilient materials. Preferably, the web is formed from a transparent and elastomeric polymer film, and in preferred embodiments may be formed from polyvinyl chloride or polyurethane ester. By way of comparison, polyvinyl chloride films are generally less expensive and more transparent and may be more preferable for lightweight applications wherein a thickness of only 2–4 mils is necessary. Films made of polyurethane ester are generally more elastomeric and puncture resistant, and are therefore better suited for larger articles and articles having sharp protrusions. Polyurethane ester also is generally less sensitive to temperature changes and more tacky, which is useful for restraining the packaged article from slipping. Polyurethane ester films may be manufactured with a slip agent, however, to control excessive tackiness. A particularly preferred resin used in the manufacture of the film is SP876, a commercially available product of the BASF Company. It will be appreciated, however, that a number of polymeric materials are suitable for forming the flexible film, and that such materials may be readily selected or custom designed by those of ordinary skill in the art to obtain the desired properties.

Figure 1:
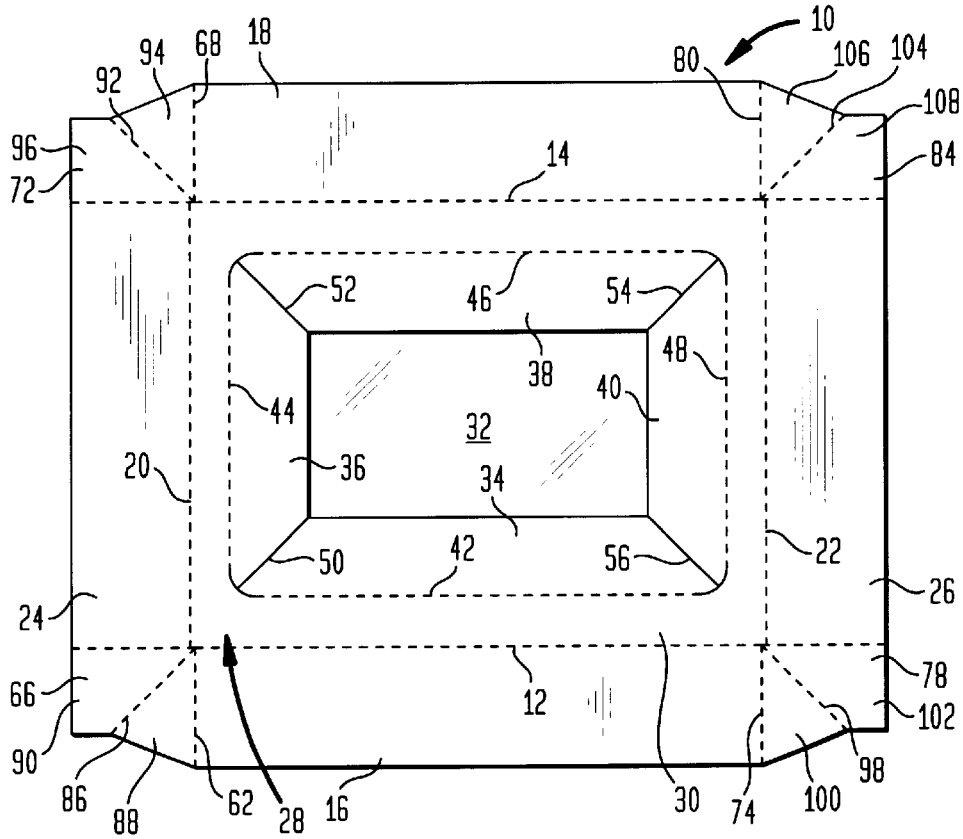
FIG. 1 is a bottom plan view of a blank for forming a packaging structure in accordance with one embodiment of the present invention.
Figure 2:
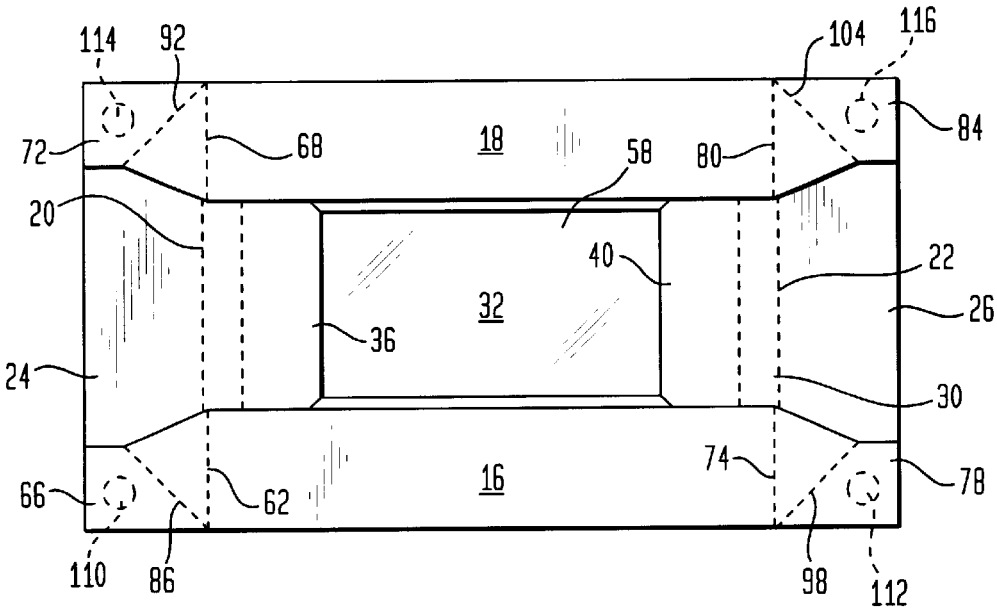
FIG. 2 is a bottom plan view of the blank of FIG. 1 in an intermediate folded condition.
Figure 3:
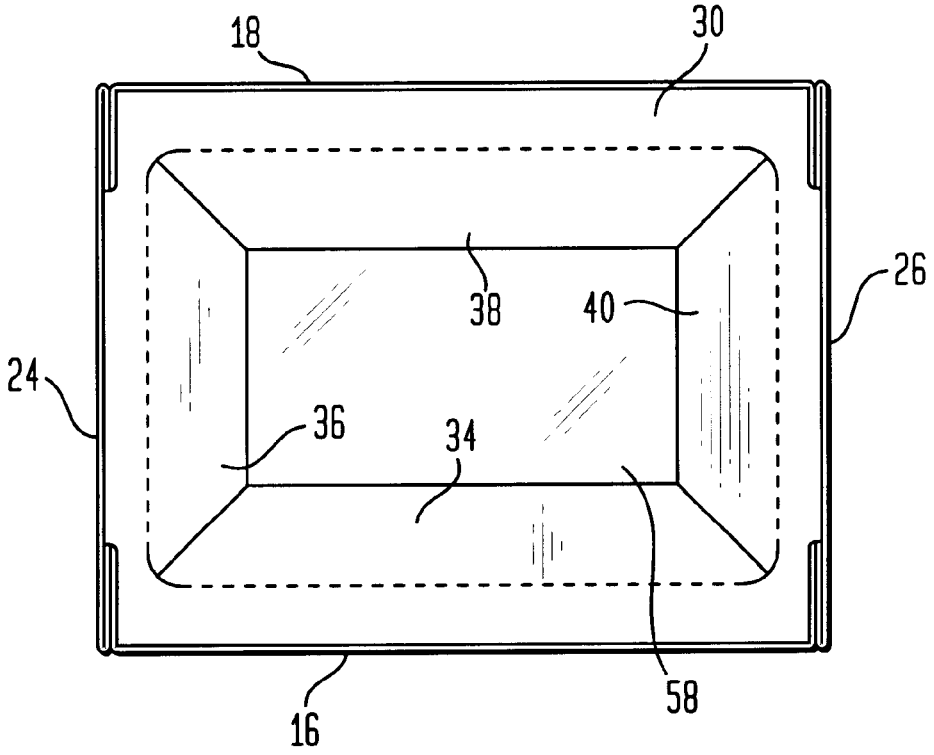
FIG. 3 is a bottom plan view of the packaging structure constructed from the blank of FIG. 1.
Figure 4:
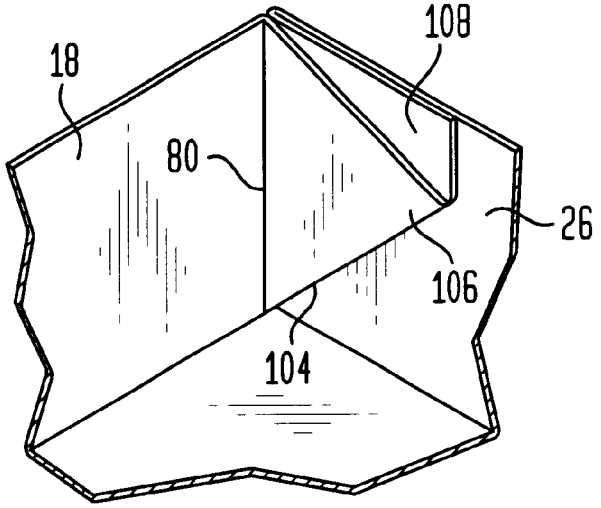
FIG. 4 is an enlarged detailed view showing an interior corner of the packaging structure of FIG. 3.

Referring to the figures, a blank 10 for forming a packaging structure 11 in accordance with one embodiment of the present invention is shown in FIG. 1. Packaging structure 11 is of a type typically used in suspension forms of packages. The broken lines depicted in FIG. 1, as well as in the other figures depicting blanks herein, represent lines along which the blank is creased, crimped, embossed, perforated, scored or otherwise weakened so as to be folded into the final shape of the packaging structure. The thickened full lines represent slits cut through the entire thickness of blank 10.

Blank 10 includes a pair of fold lines 12 and 14 which are generally parallel to and spaced from the opposite side edges of the blank, and which thus define folding side legs 16 and 18, respectively. Blank 10 may further include a pair of fold lines 20 and 22 spaced from the opposite ends of the blank and defining folding end legs 24 and 26, respectively. Fold lines 12, 14, 20 and 22 collectively define a main portion of blank 10 indicated generally at 28. Main portion 28 may include a continuous border 30 defining a window opening 32 therein, and a series of foldable members 34, 36, 38 and 40 connected to border 30 in a cantilevered fashion along fold lines 42, 44, 46 and 48, respectively. Adjacent members may be separated from one another by through slits, such as slits 50, 52, 54 and 56, thereby enabling the members to pivot independently of one another.

Fold line 12 may include one or more through slits (not shown) extending partially along its length, leaving a sufficient portion of the fold line intact to securely join side leg 16 to border 30. Similar through slits may extend partially along fold lines 14, 20 and 22 so long as sufficient amounts of the fold lines are left intact to securely join side leg 18 and end legs 24 and 26 to border 30. The formation of slits through the fold lines facilitates the folding of the side legs and end legs from their positions in blank 10 to the use condition by reducing the amount of material which has to be folded.

A flexible film 58 is superimposed on the front surface of blank 10 so that it extends across main portion 28. Film 58 preferably is secured to border 30 by any suitable means, including stapling, gluing, hot melt adhesive, heat or ultrasonic welding and the like. In a particularly preferred arrangement, film 58 may be adhered to border 30 by a continuous glue strip 60 circumscribing the entirety of window opening 32.

Side legs 16 and 18 include an end portion foldably connected to each end thereof. Thus, side leg 16 includes a fold line 62 extending from fold line 12 to the side edge of blank 10 to define at one end of side leg 16 a folding end portion 66. Side leg 18 includes a fold line 68 extending from fold line 14 to the side edge of blank 10, defining at one end of side leg 18 a folding end portion 72. In a preferred arrangement, fold lines 62 and 68 may be offset inwardly by a small amount from fold line 20 to accommodate the thickness of folding end portions 66 and 72 when folded to the use condition described below. Similarly, the opposite end of side leg 16 includes a fold line 74 extending from fold line 12 to the side edge of blank 10, defining a folding end portion 78; and side leg 18 includes at its opposite end a fold line 80 extending from fold line 14 to the side edge of blank 10, defining a folding end portion 84. Fold lines 74 and 80 may be offset inwardly by a small amount from fold line 22 to accommodate the thickness of folding end portions 78 and 84 when in the folded use condition. Although folding end portions 66 and 78 are illustrated in FIG. 1 as being connected to end legs 24 and 26, respectively, by continuations of fold line 12, that need not be the case. That is, blank 10 may include a through slit extending from one end of blank 10 to fold line 20 so as to separate folding end portion 66 from end leg 24, and another through slit from the opposite end of blank 10 to fold line 22 to separate folding end portion 78 from end leg 22. Similarly, a through slit may extend from an end of blank 10 to fold line 20 to separate folding end portion 72 from end leg 24, and another through slit may extend from the opposite end of blank 10 to fold line 22 to separate folding end portion 84 from end leg 26.

Each of the folding end portions may include an additional fold line dividing the folding end portion into two sections. This additional fold line preferably is oriented in an oblique direction relative to the fold line defining the folding end portion. Thus, folding end portion 66 may include an intermediate fold line 86 extending from the intersection of fold lines 12 and 62 to the side edge of blank 10, dividing folding end portion 66 into sections 88 and 90; folding end portion 72 may include intermediate fold line 92 extending from the intersection of fold lines 14 and 68 to the side edge of blank 10, dividing folding end portion 72 into sections 94 and 96; folding end portion 78 may include intermediate fold line 98 extending from the intersection of fold lines 12 and 74 to the side edge of blank 10, dividing folding end portion 78 into sections 100 and 102; and folding end portion 84 may include intermediate fold line 104 extending from the intersection of fold lines 14 and 80 to the side edge of blank 10, dividing folding end portion 84 into sections 106 and 108.

The formation of packaging structure 11 from blank 10 and the use of a pair of packaging structures 11 to securely hold an article A can best be understood with reference to FIGS. 2–5. With blank 10 in a face down orientation (i.e., with film 58 facing downwardly), packaging structure 11 may be placed in an intermediate folded condition shown in FIG. 2 simply by folding side legs 16 and 18 against the rear surface of blank 10. More particularly, side leg 16 may be folded along fold line 12 until it contacts the rear surface of border 30, i.e., the surface of border 30 opposite film 58. Once in this folded position, section 90 of folding end portion 66 may be secured to end leg 24, and section 102 of folding end portion 78 may be secured to end leg 26 by any suitable means, including stapling, gluing, hot melt adhesives, cold set adhesives, mechanical interlocks such as interlocking tabs, and the like. In a particularly preferred arrangement, sections 90 and 102 may be adhered to the end legs by deposits 110 and 112 of a hot melt adhesive. Section 96 of folding end portion 72 and section 108 of folding end portion 84 may be adhered to the end legs by deposits 114 and 116 of a hot melt adhesive in a similar fashion. Placing packaging structure 11 in the intermediate folded condition does not affect the positions of end legs 24 and 26 which remain in unfolded positions substantially coplanar with one another and with main portion 28. Side legs 16 and 18 lie substantially parallel to the plane defined by end legs 24 and 26 and main portion 28. In this intermediate folded condition, a plurality of packaging structures 11 may be packed in an outer box and shipped to a customer for use. The fact that the thickness of each packaging structure 11 in the intermediate folded condition is only twice the thickness of blank 10 enables a greater number of packaging structures to be packed in an outer box than packaging structures which have greater thicknesses in the intermediate folded condition.

As a result of its construction, packaging structure 11 is easily and quickly folded to a use condition by an end user. This may be accomplished by initially pulling side legs 16 and 18 upwardly away from main portion 28. As side leg 16 is pulled upwardly, its end portion 66 folds along fold lines 62 and 86. This folding action causes section 88 to move away from end leg 24, pulling end leg 24 upwardly along fold line 20. Similarly, the upward movement of side leg 16 causes its end portion 78 to fold along fold lines 74 and 98. This action causes section 100 to move away from end leg 26, pulling end leg 26 upwardly along fold line 22. The same action occurs with side leg 18. That is, as side leg 18 is pulled upwardly, its end portion 72 folds along fold lines 68 and 92, resulting in movement of section 94 away from end leg 24 and the pivoting of end leg 24 upwardly along fold line 20. The upward movement of side leg 18 also causes its end portion 84 to fold along fold lines 80 and 104, causing section 106 to move away from end leg 26, and the resultant pivoting of end leg 26 upwardly along fold line 22. After side legs 16 and 18 have been pulled upwardly by an amount sufficient to commence the folding of end legs 24 and 26, the end legs may be pushed toward one another. As this folding action proceeds, section 88 at one end of side leg 16 will move toward and ultimately against section 90, and section 94 at one end of side leg 18 will move toward and ultimately against section 96. At the completion of this folding sequence, side legs 16 and 18 will be substantially perpendicular to end leg 24, and all of these side and end legs will project away from main portion 28. A similar folding action occurs at the opposite end of side legs 16 and 18 such that, at the completion of the folding sequence, side legs 16 and 18 will be substantially perpendicular to end leg 26, and the side legs and end leg 26 will project away from main portion 28. It will be noted that, in this use condition, structures are formed at the corners of packaging structure 11 which are three times the thickness of blank 10. Thus, referring to FIG. 4, one corner of packaging structure 11 includes end leg 26 and sections 106 and 108 superimposed adjacent one another. This structure, which is formed at each corner of packaging structure 11 in the use condition, reinforces the corners, improving the overall strength of the packaging structure.

Figure 5:
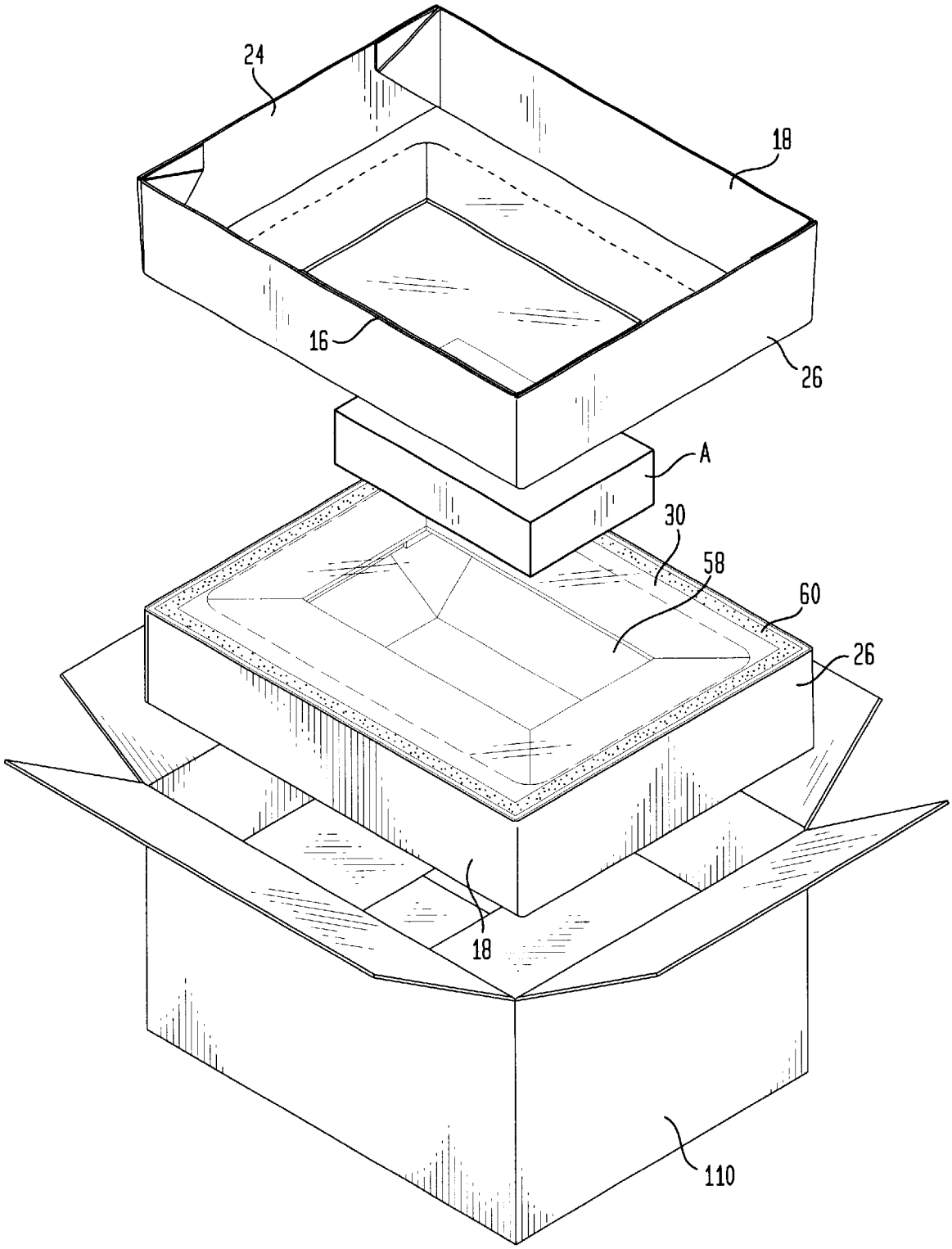
FIG. 5 is an exploded view showing the use of two of the packaging structures of FIG. 3 for packaging an article in an outer container.

With the side and end legs folded upwardly, packaging structure 11 may be inverted and inserted into an empty box 110 having a height which is about twice the height of packaging structure 11 in the use condition. The article A to be packaged may then be placed on the surface of film 58, preferably in a central region thereof, and a second packaging structure 11 may be inserted into box 110 so that the film 58 thereof contacts the article, as shown in FIG. 5. The upper packaging structure 11 may then be pushed downwardly until it fits entirely within box 110, causing films 58 to bulge away from one another, cradling article A therebetween and holding it securely in place. As a result of the bulging of films 58, the members 34, 36, 38 and 40 in each packaging structure are folded along their respective fold lines away from the article and toward the void space behind the film. With the upper packaging structure 11 entirely within box 110, the outer flaps of the box may be folded into the closed position and sealed in a conventional manner using tape, glue, staples or other well-known techniques to hold the box closed.

When two packaging structures 11 are holding an article in place within an outer box, films 58 are stretched, creating tension therein which exerts an inward force on both the side legs and the end legs of the packaging structures. However, because of the presence of continuous border 30, packaging structure 11 has sufficient strength to withstand that force. As those skilled in the art will appreciate, the presence of folds adds strength to sheet materials such as corrugated cardboard. Packaging structure 11 in the use condition has two folds on each side and each end, a first fold joining the side leg or end leg to the outer edge of border 30, and a second fold joining a foldable member to the inner edge of border 30. The presence of these two folds on each side and each end of packaging structure 11 increases its structural rigidity and keeps the packaging structure from collapsing under the weight of article A during shipment.

Depending upon the application for packaging structure 11, border 30 need not be formed as a continuous border along both side legs and both end legs thereof. Thus, size constraints and the need for at least selective reinforcement may compel packaging structure 11 to be formed with border 30 adjacent only the end legs of the packaging structure or adjacent only the side legs of the packaging structure. While border 30 increases the use strength of packaging structure 11, it has the effect of increasing the overall package size and for that reason is more costly to use.

Figure 6:
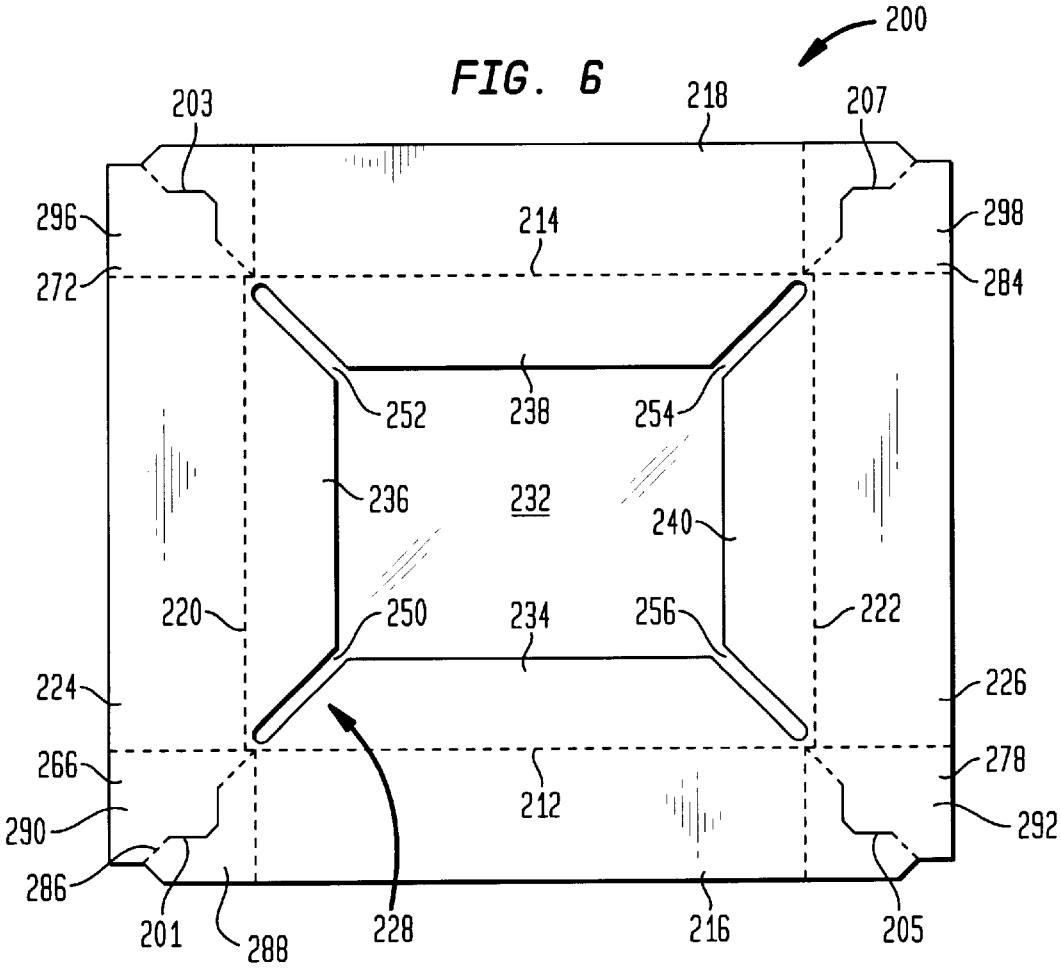
FIG. 6 is a bottom plan view of a blank for forming a packaging structure in accordance with a second embodiment of the present invention.
Figure 7:
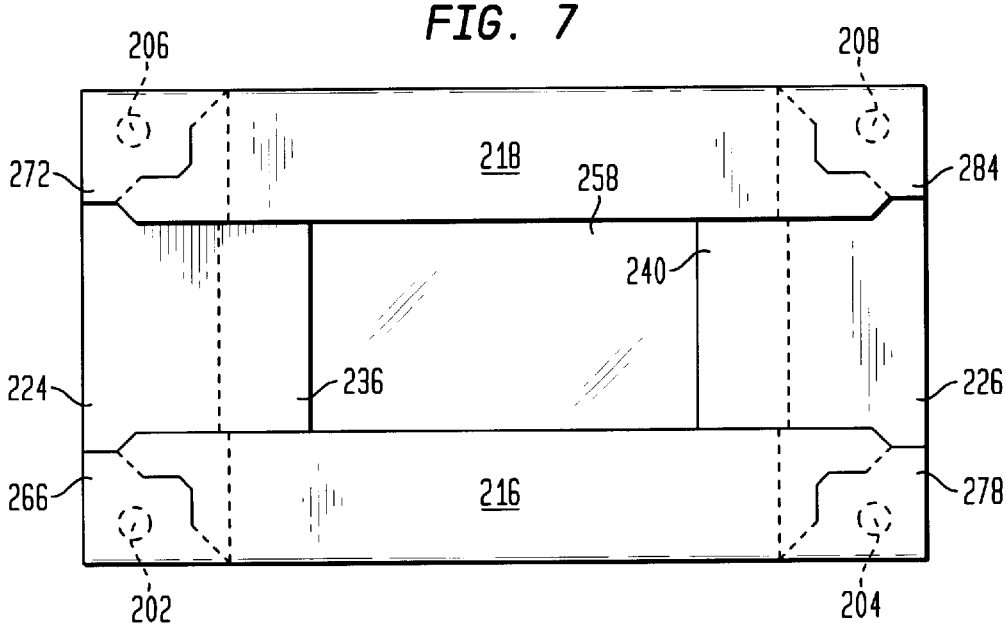
FIG. 7 is a bottom plan view of the blank of FIG. 6 in an intermediate folded condition.
Figure 8:
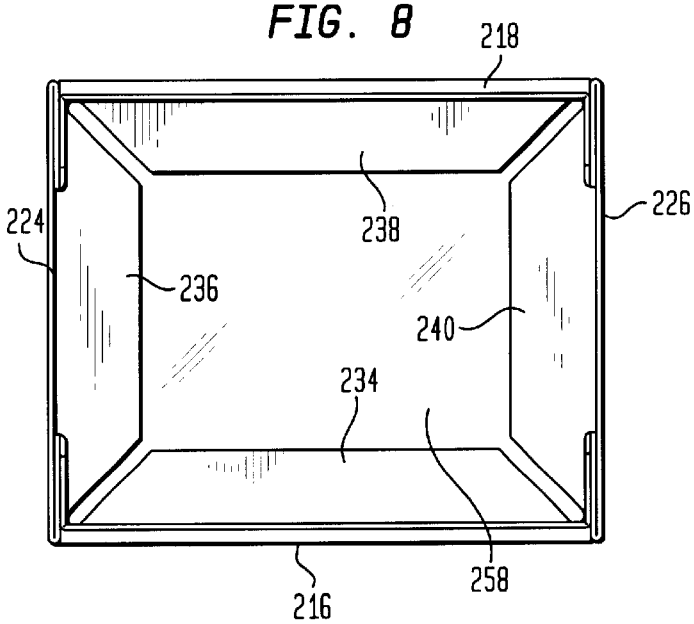
FIG. 8 is a bottom plan view of the packaging structure constructed from the blank of FIG. 6.
Figure 9:
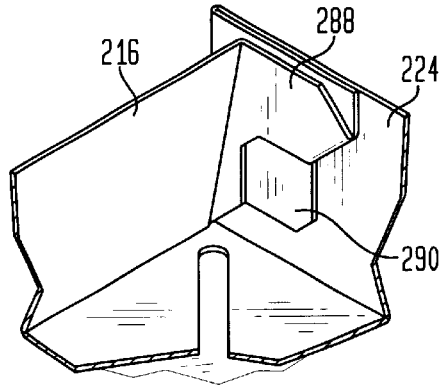
FIG. 9 is an enlarged detailed view showing an interior corner of the packaging structure of FIG. 8.

A blank 200 for forming a packaging structure 211 in accordance with a second embodiment of the present invention is shown in FIG. 6. Blank 200 is similar in construction to blank 10 described above, but forms a packaging structure which is smaller and thus less costly to use than packaging structure 11 for a given size window opening. Unlike blank 10, the main portion 228 of blank 200 does not include a continuous border defining window opening 232. Rather, window opening 232 is defined by fold lines 212 and 214 spaced from the side edges of the blank, and by fold lines 220 and 222 spaced from the end edges of the blank. Fold lines 212, 220, 214 and 222 may also serve as attachment points for foldable members 234, 236, 238 and 240, respectively. Adjacent members may be separated from one another by elongated slots 250, 252, 254 and 256 which enable the members to move independently of one another. Although, for certain applications, slots 250, 252, 254 and 256 may terminate at fold lines 212, 214, 220 and 222, preferably, the slots do not extend entirely to these fold lines, as illustrated in the figures. Rather, the slots may terminate at curved ends spaced from these fold lines in order to increase the structural strength of packaging structure 211 in the use condition.

Blank 200 also differs from blank 10 in the manner in which film 258 is connected to the blank. Since there is no continuous border in blank 200, film 258 may be adhered to side legs 216 and 218 and end legs 224 and 226 by a continuous glue strip 260. Preferably, glue strip 260 is positioned on side leg 216 adjacent fold line 212, on end leg 224 adjacent fold line 220, on side leg 218 adjacent fold line 214, and on end leg 226 adjacent fold line 222.

Blank 200 may also include a series of generally L-shaped slits in folding end portions 266, 272, 278 and 284. More particularly, folding end portion 266 may include a substantially L-shaped slit 201 which projects from fold line 286 into section 288. Slit 201 has the effect of increasing the area of section 290 by the amount within the slit, thereby increasing the area of contact between section 290 and end leg 224 in the intermediate folded condition described below. This increase in area provides a greater degree of latitude in positioning an adhesive deposit 202 to secure section 290 to the end leg. Similar L-shaped slits 203, 205 and 207 may be formed in folding end portions 272, 278 and 284, respectively. In addition to providing a greater potential area for securing the end portions to the end legs, L-shaped slits 201, 203, 205 and 207 decrease the foldable length of intermediate fold lines 286, etc., thereby reducing the effort needed to fold packaging structure 211 from the intermediate folded condition to the use condition as described below.

Figure 10:
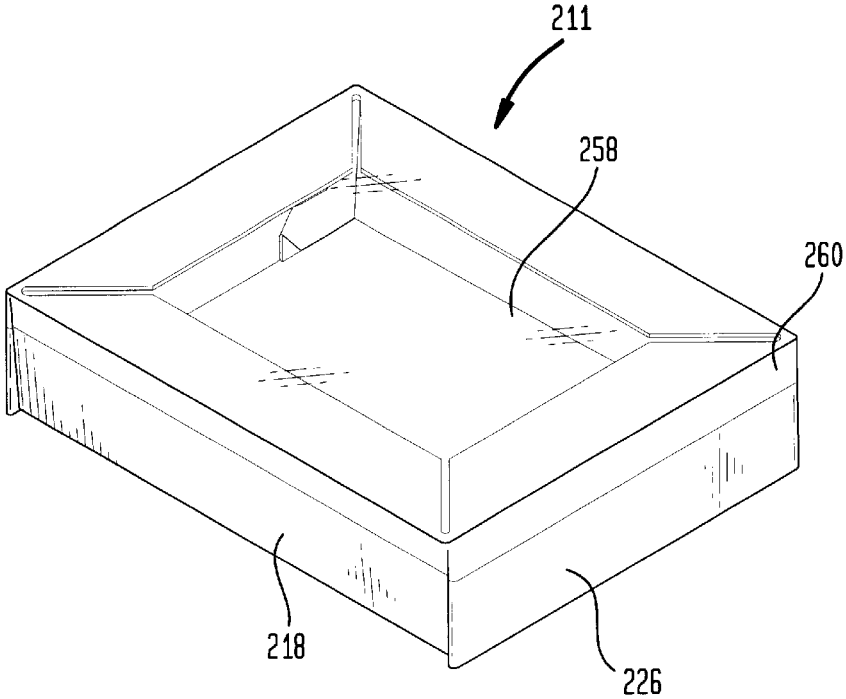
FIG. 10 is a perspective view of the packaging structure of FIG. 8.

Using substantially the same technique as described in connection with blank 10, blank 200 may be folded to form the packaging structure 211 shown in FIG. 10. Following this procedure, blank 200 may initially be placed in an intermediate folded condition by folding side legs 216 and 218 against the rear surface of blank 200. In this position, section 290 of folding end portion 266 may be secured to end leg 224, and section 292 of folding end portion 278 may be secured to end leg 226, such as with deposits 202 and 204 of a hot melt adhesive. Section 296 of folding end portion 272 and section 298 of folding end portion 284 also may be secured to end legs 224 and 226, respectively, such as with deposits 206 and 208 of a hot melt adhesive. Again, in this intermediate folded condition, packaging structures 211 have a thickness which is only twice the thickness of blank 200, thereby enabling a high density of packaging structures to be packed in an outer box and shipped to a customer for use.

As with packaging structure 11 described above, packaging structure 211 may readily be converted from the intermediate folded condition to a use condition by initially pulling side legs 216 and 218 upwardly away from main portion 228, which action causes end legs 224 and 226 to begin to pivot upwardly toward the ends of side legs 216 and 218. Once this folding has been initiated, end legs 224 and 226 may be pushed toward one another until they reach a position substantially perpendicular to main portion 228. A pair of packaging structures 211 may be used in the same face to face arrangement as packaging structures 11 described above to hold an article in a suspended position within an outer container.

Side legs 216 and 218 of packaging structure 211 may be oriented in a position substantially perpendicular to the main portion when folded to the use condition, as in packaging structure 11 described above. Preferably, however, the side legs of packaging structure 211 in the use condition are canted inwardly to form an acute angle with main portion 228. The reason for this is that, since film 258 is connected to the side legs and end legs of packaging structure 211, the tension in the film when in use will exert a force tending to pull these legs toward the middle of the structure. Canting the side legs inwardly reinforces these legs and keeps them from collapsing under such inward stress. It will be appreciated by those skilled in the art that the angle between the intermediate fold lines and the fold lines connecting the folding end portions to the side legs will determine the angle formed between the side legs and main portion 228 in the use condition. For angles of about 45° between the fold lines, side legs 216 and 218 will be substantially perpendicular to main portion 228 in the use condition. For angles which are less than 45°, side legs 216 and 218 will slant inwardly in the use condition, forming an acute angle with main portion 228. When the side legs are canted inwardly, it is desirable to increase the width of side leg 216 between fold line 212 and the free edge thereof and the width of side leg 218 between fold line 214 and the free edge thereof so that the free edges of the side legs lie in the same plane as the free edges of end legs 224 and 226. In this way, the stress exerted on packaging structure 211 by an article during shipment will be more evenly distributed among both the side legs and the end legs. The inward canting of the side legs is not limited to packaging structures which do not have a border defining the window opening. For example, packaging structure 11 having continuous border 30 may be designed so that its side legs are canted inwardly in the use condition where desired.

It will be appreciated that packaging structure 211 may be formed without foldable members 234, 236, 238 and 240. However, as the presence of folds increases the overall structural strength of packaging structure 211, and as the foldable members do not increase the size of the packaging structure or occupy usable volume within an outer container, the presence of these foldable members is preferred.

Figure 11:
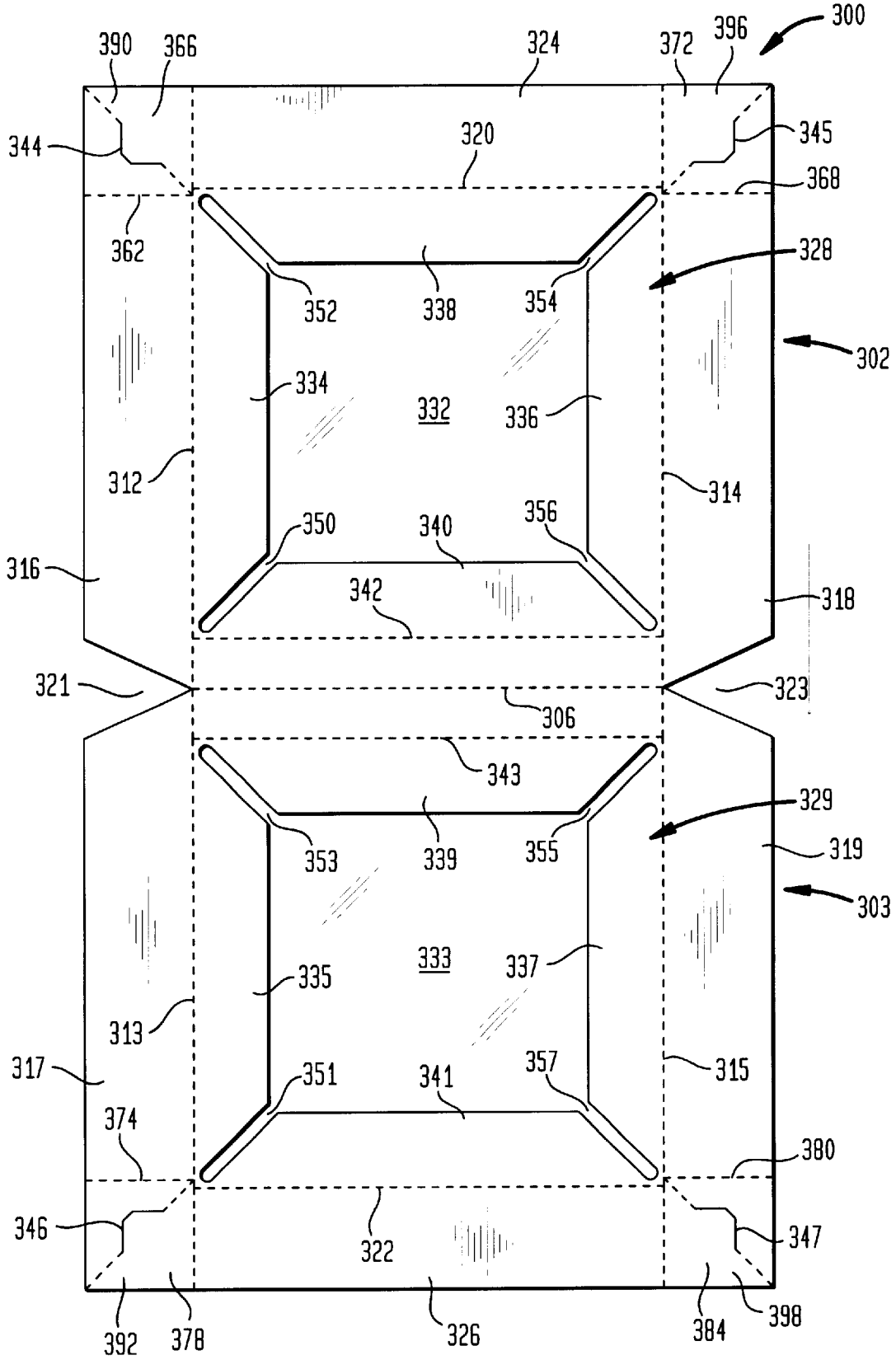
FIG. 11 is a bottom plan view of a blank for forming a packaging structure in accordance with a third embodiment of the present invention.

A blank 300 for forming a packaging structure 311 in accordance with a third embodiment of the present invention is shown in FIG. 11. Packaging structure 311 essentially consists of two packaging structures 211 hingedly connected to one another in a clamshell arrangement. Thus, blank 300 includes a first panel 302 and a second panel 303 which are mirror images of one another and which are hingedly connected to one another by a fold line 306. Panel 302 includes a pair of fold lines 312 and 314 which are spaced from the opposite side edges thereof, and which define folding side legs 316 and 318, respectively. Similarly, panel 303 includes fold lines 313 and 315 which are substantially colinear with fold lines 312 and 314, respectively, and which define folding side legs 317 and 319. Side leg 316 may be separated from side leg 317 by a V-shaped notch 321 cut in one side edge of blank 300, and side legs 318 and 319 may be separated from one another by a V-shaped notch 323 cut in the opposite side edge of blank 300. A fold line 320 spaced from one end of blank 300 defines a folding end leg 324 at the free end of panel 302, and a fold line 322 spaced from the opposite end of blank 300 defines a folding end leg 326 at the free end of panel 303. Collectively, fold lines 312, 314 and 320, along with a fold line 342 spaced from fold line 306, define a main portion of panel 302 indicated generally at 328. Main portion 328 may include a window opening 332 defined by fold lines 312, 314, 320 and 342, and a series of foldable members 334, 336, 338 and 340 connected in a cantilevered fashion to these fold lines, respectively. Adjacent members may be separated from one another by slots 350, 352, 354 and 356 so that the members may pivot independently of one another. Panel 303 may have the same construction. That is, fold lines 313, 315 and 322, together with a fold line 343 spaced from fold line 306, define a main portion 329 of panel 303. Main portion 329 may include a window opening 333 defined by fold lines 313, 315, 322 and 343, and a series of foldable members 335, 337, 339 and 341 connected to these fold lines, respectively. Adjacent ones of these foldable members may be separated from one another by slots 351, 353, 355 and 357 so that the members may pivot independently with respect to one another.

A film 358 is connected to blank 300 so that it spans window openings 332 and 333. In that regard, film 358 preferably is secured to side legs 316, 317, 318 and 319 and to end legs 324 and 326 by a pair of glue strips 350 and 351. Glue strip 350 may be positioned on side leg 316 adjacent fold line 312, on end leg 324 adjacent fold line 320, and on side leg 318 adjacent fold line 314. Glue strip 351 may be positioned on side leg 317 adjacent fold line 313, on end leg 326 adjacent fold line 322 and on side leg 319 adjacent fold line 315.

Side legs 316 and 318 each include a folding end portion on their ends adjacent end leg 324. Thus, side leg 316 includes a folding end portion 366 foldably connected thereto along fold line 362, and side leg 318 includes a folding end portion 372 foldably connected thereto along a fold line 368. Folding end portions 366 and 372 may be similar to the folding end portions described above in connection with packaging structures 11 and 211. Similar folding end portions are formed on the ends of side legs 317 and 319 adjacent end leg 326. More particularly, side leg 317 includes a folding end portion 378 foldably connected thereto along fold line 374, and side leg 319 includes a folding end portion 384 foldably connected thereto along a fold line 380. Although end portions 366, 372, 378 and 384 are illustrated as including L-shaped through slits 344, 345, 346 and 347 in FIG. 11, the end portions may be formed without these through slits as in packaging structure 11 described above.

Figure 12:
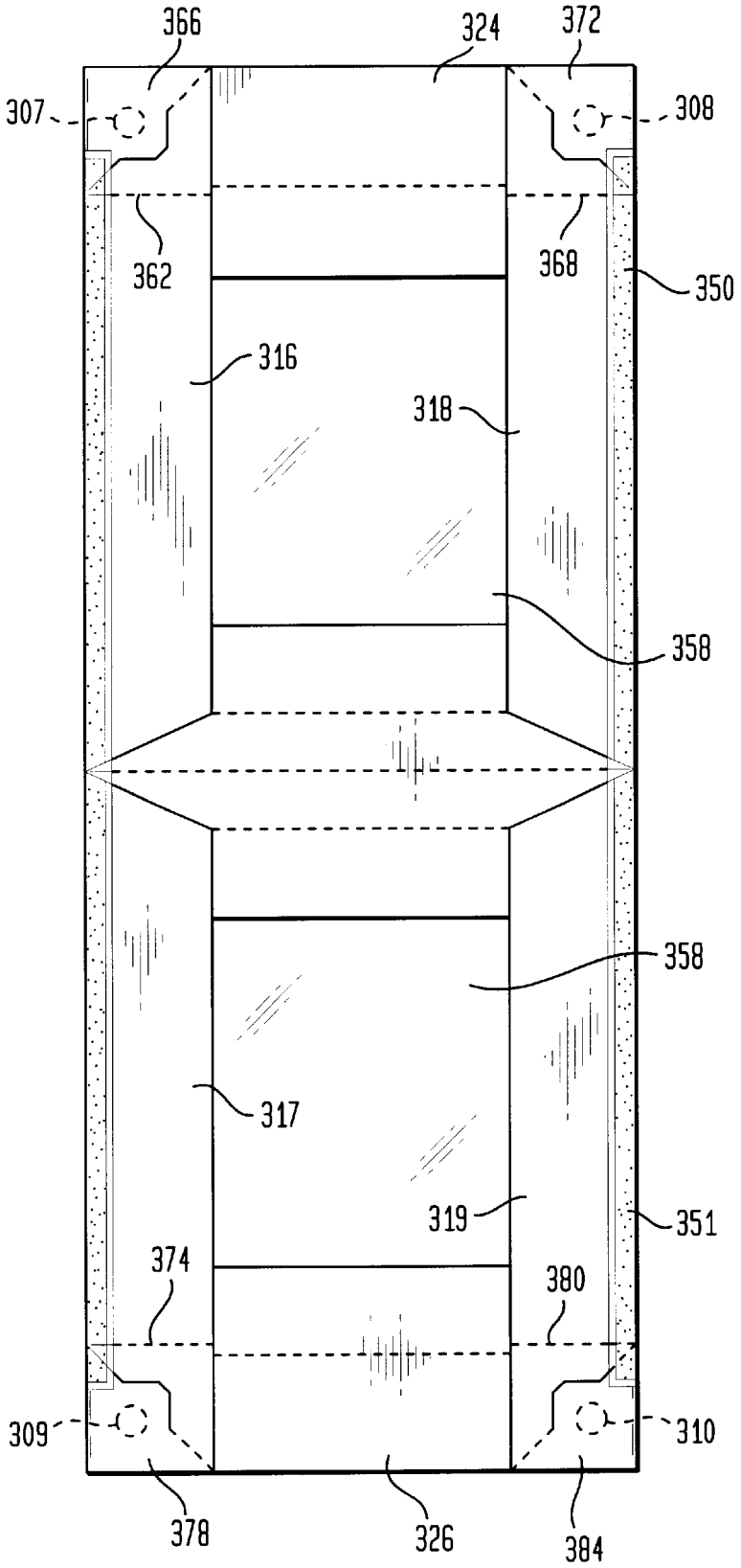
FIG. 12 is a bottom plan view of the blank of FIG. 11 in an intermediate folded condition.

The first step in forming packaging structure 311 from blank 300 is to fold blank 300 into the intermediate folded condition shown in FIG. 12. This is accomplished by folding side legs 316 and 318 against the rear surface of panel 302, and side legs 317 and 319 against the rear surface of panel 303. Once in this folded position, section 390 of folding end portion 366 and section 396 of folding end portion 372 may be secured to end leg 324, such as with deposits 307 and 308 of a hot melt adhesive. Similarly, section 392 of folding end portion 378 and section 398 of folding end portion 384 may be secured to end leg 326, such as with deposits 309 and 310 of a hot melt adhesive. Hence, in the intermediate folded condition, end legs 324 and 326 remain in unfolded positions substantially in a plane with one another and with main portions 328 and 329 and side legs 316, 317, 318 and 319 lie substantially parallel to that plane. As with packaging structures 11 and 211 described above, packaging structure 311 in this intermediate folded condition has a thickness which is only twice the thickness of blank 300. As a result, a high density of packaging structures 311 may be packed in an outer box for shipment to a customer.

Figure 13:
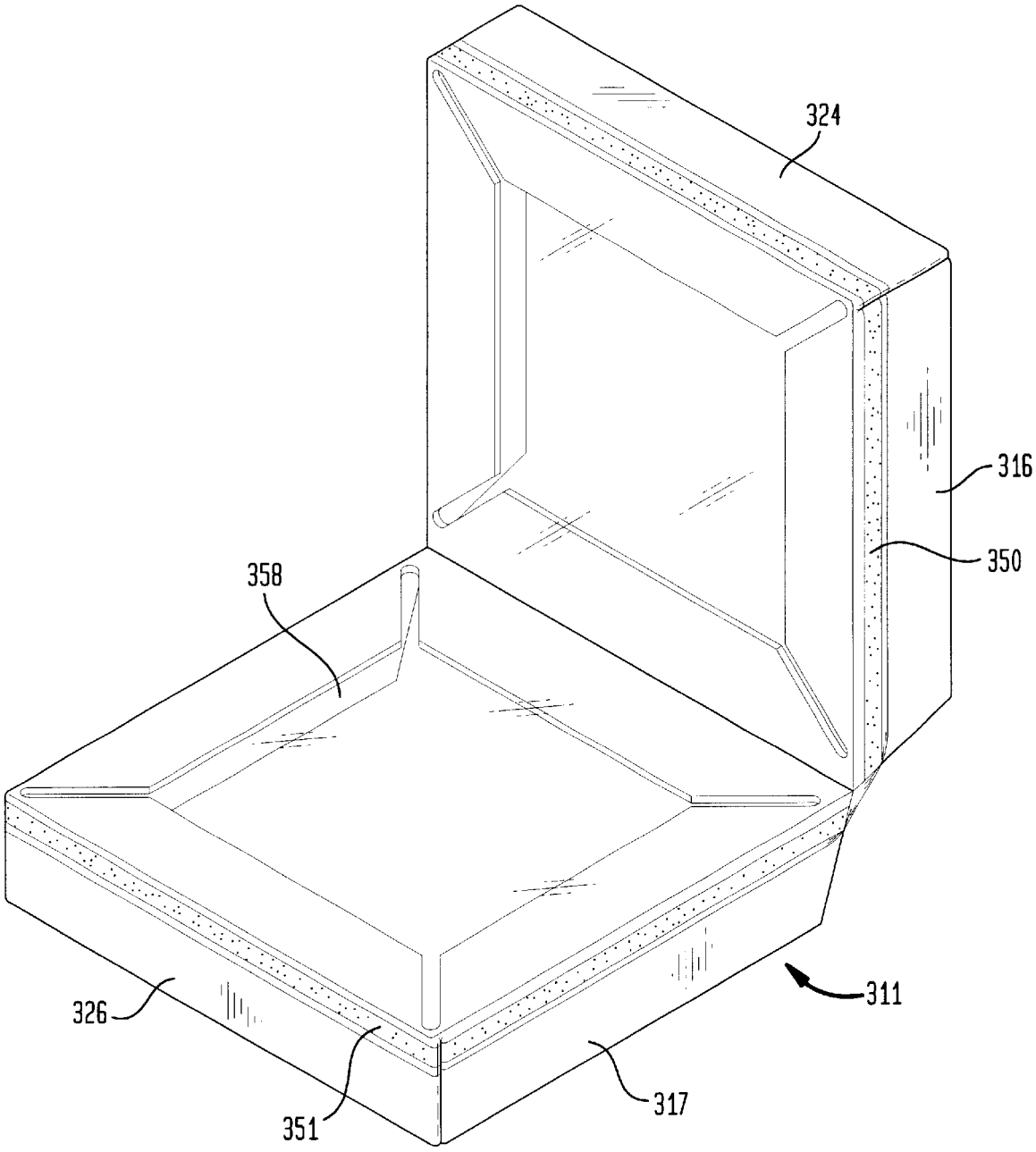
FIG. 13 is a perspective view of the packaging structure constructed from the blank of FIG. 11.

Following substantially the same technique as described above in connection with packaging structure 11, packaging structures 311 may be converted readily from the intermediate folded condition to a use condition by an end user. To accomplish this, the user simply pulls side legs 316 and 318 upwardly away from main portion 328, causing end leg 324 to begin pivoting upwardly toward the ends of side legs 316 and 318. Subsequently, side legs 317 and 319 are pulled upwardly away from main portion 329, causing end leg 326 to begin pivoting upwardly toward the ends of side legs 317 and 319. End legs 324 and 326 may then be pushed toward one another until they reach positions substantially perpendicular to main portions 328 and 329. Once this folding sequence has been completed, panels 302 and 303 may be folded toward one another (and away from the side legs and end legs) along fold line 306 to the position shown in FIG. 13. In this position, an article to be packaged may be placed on the film 358 on one portion of packaging structure 311 and the other portion of packaging structure 311 may be closed thereover, whereby portions of film 358 cradle the article and hold it securely in place. The packaging structure may be placed in an outer box or other container which holds the packaging structure in the folded condition during shipment.

Figure 14:
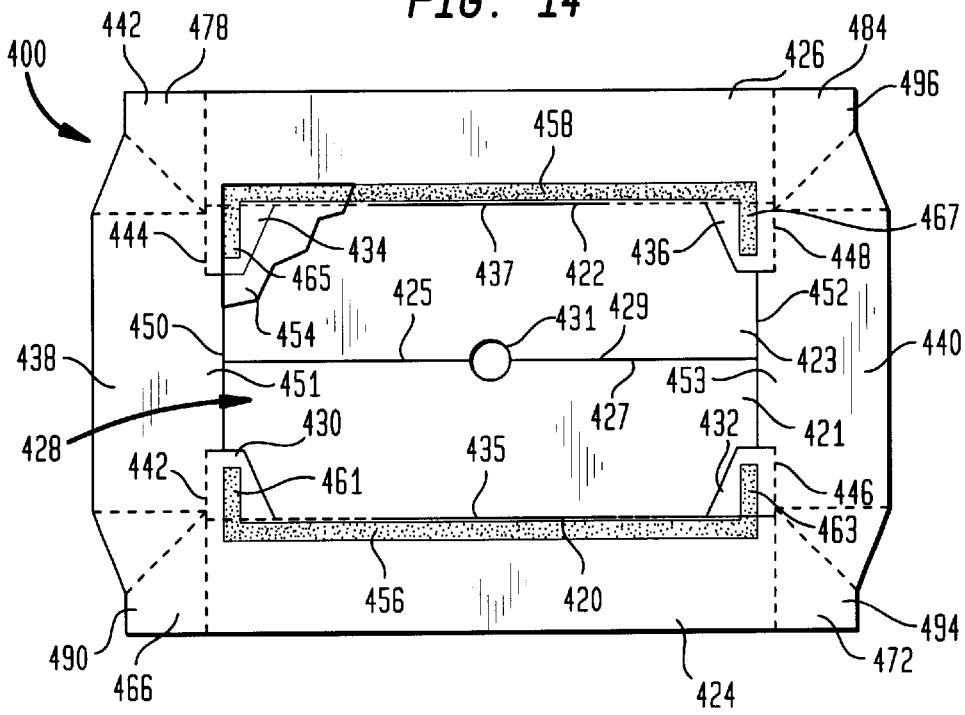
FIG. 14 is a bottom plan view of a blank for forming a packaging structure in accordance with a fourth embodiment of the present invention.

A blank 400 for forming a packaging structure 411 in accordance with a fourth embodiment of the present invention is shown in FIG. 14. Packaging structure 411 is of a type typically used in retention forms of packages. Blank 400 includes a pair of fold lines 412 and 414 which are generally parallel to and spaced from the opposite side edges of the blank, and which thus define folding side legs 416 and 418, respectively, and a main portion indicated generally at 420 therebetween. Main portion 420 may include a pair of flaps 422 and 424, and a series of corner portions 426, 428, 430 and 432. Flap 422 may be connected to side leg 416 along the portion of fold line 412 extending between corner portions 426 and 428, and has a width extending from fold line 412 to a free edge 423 thereof. In the same manner, flap 424 may be connected to side leg 418 along the portion of fold line 414 extending between corner portions 430 and 432, and has a width extending from fold line 414 to a free edge 425. By pivoting flaps 422 and 424 about these respective fold lines, the flaps may be moved between an open position in which they are spaced above corner portions 426, 428, 430 and 432 to reveal a window 433 in main portion 420, and a closed position in which they are coplanar with one another to form a layer covering substantially the entirety of window 433. The widths of flaps 422 and 424 may be substantially equal such that, in the closed position, their free edges 423 and 425 define a seam 427 which is disposed substantially along the centerline of main portion 420. Cutouts in free edges 423 and 425 may also define a finger hole 429 in the closed position providing a location to grasp the flaps for movement from the closed position to the open position. Alternatively, one or more finger holes may be provided entirely within the body of one or both of flaps 422 and 424.

Fold line 412 may include one or more through slits 434 extending partially along its length, leaving a sufficient portion of the fold line intact to securely join flap 422 to side leg 416. Similarly, one or more through slits 436 may extend partially along the length of fold line 414, leaving a sufficient portion of the fold line intact to securely join flap 424 to side leg 418. As described above, these slits reduce the amount of material which has to be folded in these fold lines, and thus facilitate the folding of flaps 422 and 424 between the open and closed positions.

Blank 400 may further include a pair of folding end legs 438 and 440 which extend along the width of main portion 420. End leg 438 may be connected to corner portions 426 and 430 along colinear fold lines 442 and 444, respectively. In the same manner, end leg 440 may be connected to corner portions 428 and 432 along colinear fold lines 446 and 448, respectively. The slit 450 defining the top of end leg 438 (in the folded condition of packaging structure 411) and one end of flaps 422 and 424 may be offset inwardly from fold lines 442 and 444, thereby defining a centrally disposed projection 451 of substantially increased height in end leg 438. Likewise, the slit 452 defining the top of end leg 440 (also in the folded condition of packaging structure 411) and the other end of flaps 422 and 424 may be offset inwardly from fold lines 446 and 448, thereby creating a centrally disposed projection 453 of substantially increased height in end leg 440. The purpose of these projections will be described more fully below in connection with the use of packaging structure 411.

A flexible film 454 is superimposed on one surface of blank 400 so that it extends across main portion 420. One edge of film 454 may be connected to side leg 416, and the opposite edge of film 454 may be connected to side leg 418. Although the connection of film 454 to blank 400 may be made by any of the means described above, in a particularly preferred arrangement, film 454 may be adhered to side legs 416 and 418 by a pair of glue strips 456 and 458, glue strip 456 being positioned on side leg 416 adjacent fold line 412 and glue strip 458 being positioned on side leg 418 adjacent fold line 414. Rather than using continuous glue strips 456 and 458, film 454 may be connected to side legs 416 and 418 by pairs of shorter glue strips (not shown), one pair positioned adjacent the solid portions of fold line 412, i.e., on either side of the slit 434 through the fold line, and the other pair positioned adjacent fold line 414 on either side of slit 436. Optionally, film 454 may further be connected to the underside of corner portions 426, 428, 430 and 432, such as through the use of glue strip extensions 461, 463, 465 and 467.

Side leg 416 includes folding end portions 466 and 478 on opposite ends thereof, and side leg 418 includes folding end portions 472 and 484 on its opposite ends. Folding end portions 466, 472, 478 and 484 may be similar to the folding end portions of the embodiments described above, and may or may not include the L-shaped through slits described above in connection with blank 200.

Figure 15:
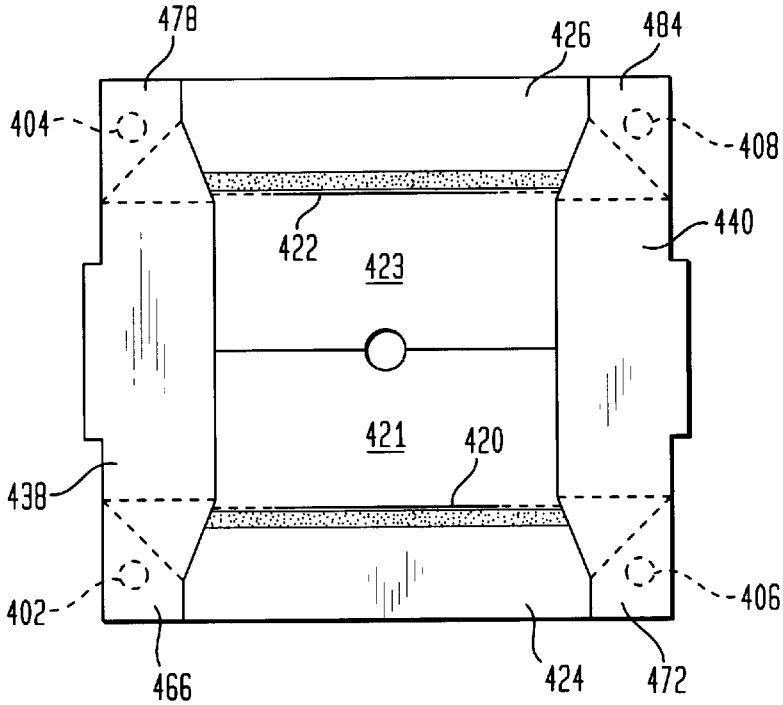
FIG. 15 is a bottom plan view of the blank of FIG. 14 in an intermediate folded condition.
Figure 16:
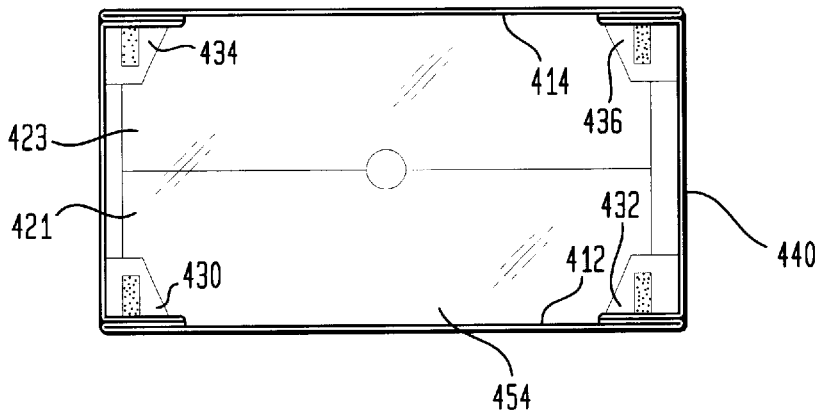
FIG. 16 is a bottom plan view of the packaging structure constructed from the blank of FIG. 14.
Figure 17:
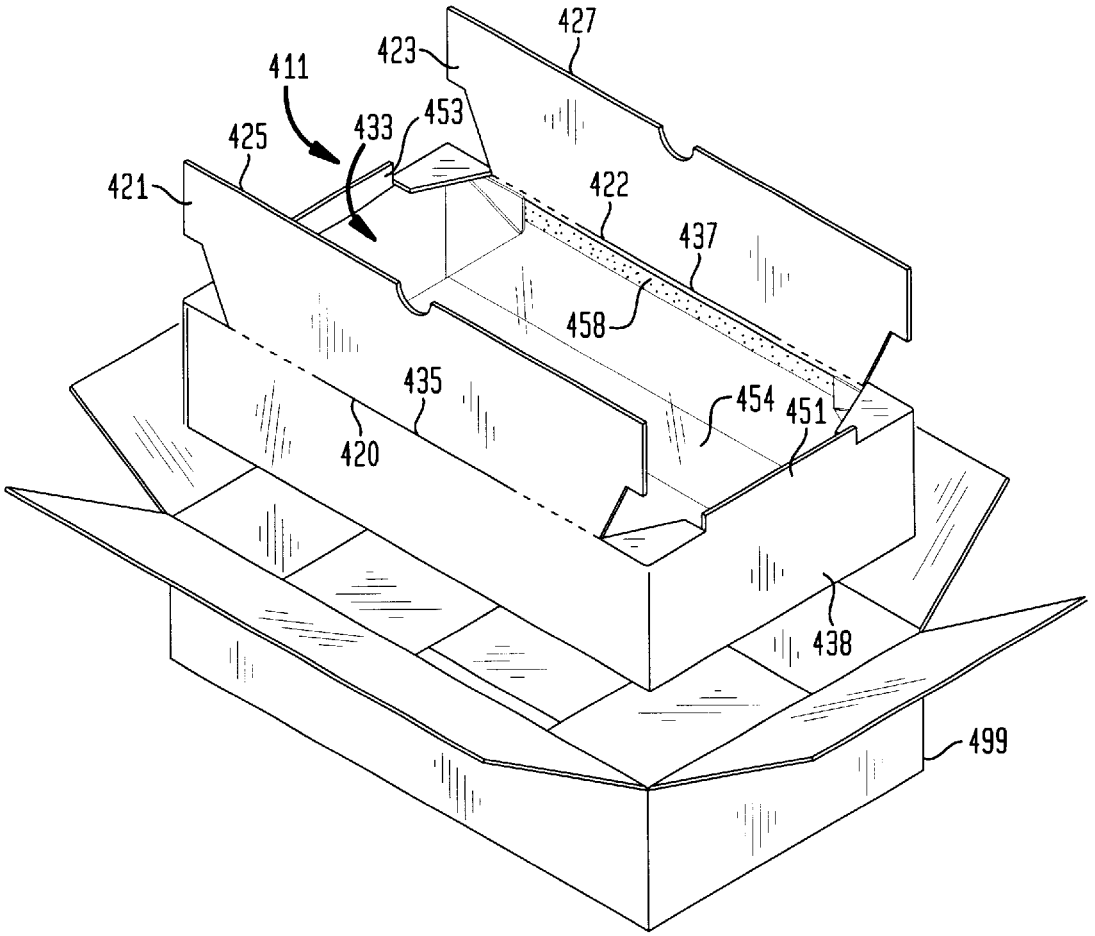
FIG. 17 is an exploded view showing the use of the packaging structure of FIG. 16 for packaging an article in an outer container.

The formation of packaging structure 411 from blank 400 and the use of the packaging structure to securely hold an article can best be understood with reference to FIGS. 15–17. With blank 400 in a face down orientation (i.e., with glue strips 456 and 458 facing upwardly), side legs 416 and 418 may be folded against the rear surface of blank 400 to place packaging structure 411 in an intermediate folded condition. Once in this folded condition, sections 490 and 492 of side leg 416 may be secured to end legs 438 and 440, respectively, such as with deposits 402 and 404 of a hot melt adhesive, and sections 494 and 496 of side leg 418 may be adhered to end legs 438 and 440, respectively, such as with adhesive deposits 406 and 408. In this intermediate folded condition, end legs 438 and 440 remain in their unfolded positions substantially coplanar with main portion 420, and flaps 422 and 424 remain in a closed position against film 454. As with the other embodiments of packaging structures described above, packaging structure 411 has a thickness in the intermediate folded condition which is only twice the thickness of blank 400. This relatively thin profile enables large numbers of packaging structures to be shipped to a customer in a minimum of space.

To convert packaging structure 411 from the intermediate folded condition to the use condition is a simple and rapid procedure. The procedure is initiated by pulling side legs 416 and 418 upwardly away from main portion 420. This folding action causes end portions 466, 472, 478 and 484 to fold, initiating a pivoting of end legs 438 and 440 toward the ends of side legs 416 and 418. Once end legs 438 and 440 have begun to fold in this direction, they may be pushed toward one another until they reach positions which are substantially perpendicular to main portion 420. Packaging structure 411 may then be inverted and flaps 422 and 424 pivoted to the open position, revealing film 454 extending tightly across and immediately subjacent to window 433. Once placed in this use condition, packaging structure 411 may be inserted into an outer box 499, an article may be placed on film 454, flaps 422 and 424 may be closed and the flaps of the outer box may be closed and sealed thereover to hold the article securely in place within the packaging structure.

As can be seen in FIG. 17, in the folded condition of packaging structure 411, projections 451 and 453 extend upwardly from end legs 438 and 440. Thus, projections 451 and 453 fill the height of outer box 499 to prevent packaging structure 411 from shifting vertically within the box. Also, projections 451 and 453 define an empty space or air cell between the top of box 499 and flaps 422 and 424 in the closed position, which empty space may be used to provide extra protection for the article packaged in the box or a space for packaging instruction materials, accessories or other items between the top of the flaps and the top of the box.

Many modifications may be made to packaging structure 411. For example, rather than a pair of flaps 422 and 424 as described above, the packaging structure may be provided with a single flap foldably connected to one side leg and extending in a closed position across the entire window opening. Alternatively, the packaging structure may be provided with four flaps, two flaps being foldably connected to side legs 416 and 418, and two flaps being foldably connected to end legs 438 and 440. These flaps may be triangular or rectangular in shape so that they meet in abutting relationship to enclose the window opening. Other possible modifications of packaging structure 411 are described in U.S. Pat. No. 5,893,462, the disclosure of which is hereby incorporated by reference herein.

The packaging structures of the present invention may be used with any style outer box, including the standard RSC style carton shown in FIG. 5, standard roll end lock front style cartons, standard tuck end cartons, standard roll end tuck top cartons, and other styles of slotted and die cut cartons. Additionally, the packaging structures may be used in combination with inserts forming a separate compartment within the outer box for packaging of less fragile accessories and the like.

Although the invention herein has been described with reference to particular embodiments, it is to be understood that these embodiments are merely illustrative of the principles and applications of the present invention. It is therefore to be understood that numerous modifications may be made to the illustrative embodiments. For example, rather than adhering the flexible film to the packaging structure using continuous glue strips or other continuous connecting means, regions may be deliberately formed where the film is not connected to the packaging structure, such as to accommodate increased stretch in the film or to ensure that only the strongest portions of the packaging structure support the packaged article. Still other modifications to the illustrative embodiments may be devised without departing from the spirit and scope of the present invention as defined by the appended claims.

What is claimed is:

1. A packaging structure adapted for insertion into an outer box, comprising a panel having a front surface and a rear surface;

a first pair of fold lines spaced from opposite side edges of said panel to define a pair of folding side legs, each of said side legs including a first end and a second end;

a second pair of fold lines spaced from opposite end edges of said panel to define a pair of folding end legs, said side legs and said end legs delimiting a main portion of said panel having a window opening;

a first end portion connected to said first end of one of said side legs along a first fold line, said first end portion including a first intermediate fold line disposed at an oblique angle relative to said first fold line to divide said first end portion into a first region adjacent said first fold line and a second region;

a second end portion connected to said second end of one of said side legs along a second fold line, said second end portion including a second intermediate fold line disposed at an oblique angle relative to said second fold line to divide said second end portion into a first region adjacent said second fold line and a second region;

a flexible film material connected to said panel so as to extend across said window opening; and a series of foldable members, ones of said foldable members being foldably connected at one edge to said side legs, and others of said foldable members being foldably connected at one edge to said end legs;

said folding side legs being folded against said rear surface of said panel with said first end portion secured in said second region to one of said end legs and said second end portion secured in said second region to another one of said end legs to define an intermediate folded structure in which said folding end legs are substantially coplanar with one another;

said panel being foldable from said intermediate folded structure to a use condition in which said side legs and said end legs project away from said rear surface of said panel.

2. A packaging structure adapted for insertion into an outer box, comprising a pair of end legs, each of said end legs having a front surface facing in a first direction and a rear surface facing in an opposite direction;

a pair of side legs, each of said side legs including first and second ends, said side legs and said end legs delimiting a window opening;

a first end portion connected to said first end of each of said side legs along a first fold line, said first end portion including a front surface facing in said first direction, a rear surface facing in said opposite direction and a first intermediate fold line disposed at an oblique angle relative to said first fold line to divide said first end portion into a first region adjacent said first fold line and a second region;

a second end portion connected to said second end of each of said side legs along a second fold line, said second end portion including a front surface facing in said first direction, a rear surface facing in said opposite direction and a second intermediate fold line disposed at an oblique angle relative to said second fold line to divide said second end portion into a first region adjacent said second fold line and a second region;

a flexible film material connected to at least one of said pair of side legs and said pair of end legs so as to extend across said window opening; and a series of foldable members, ones of said foldable members being foldably connected at one edge to said side legs, and others of said foldable members being foldably connected at one edge to said end legs;

said front surfaces of said first end portions being secured in said second regions to said rear surface of one of said end legs and said front surfaces of said second end portions being secured in said second regions to said rear surface of another one of said end legs to define a preform;

said preform being foldable from an intermediate folded structure in which said end legs lie substantially in a plane and said side legs lie substantially parallel to said plane, to a use condition in which said side legs and said end legs are transverse to said plane.

3. A packaging structure adapted for insertion into an outer box, comprising a panel having a front surface and a rear surface;

a first pair of fold lines spaced from opposite side edges of said panel to define a pair of folding side legs, each of said side legs including a first end and a second end;

a second pair of fold lines spaced from opposite end edges of said panel to define a pair of folding end legs, said side legs and said end legs delimiting a main portion of said panel having a window opening;

a first end portion connected to said first end of each of said side legs along a first fold line, said first end portion including a first intermediate fold line disposed at an oblique angle relative to said first fold line to divide said first end portion into a first region adjacent said first fold line and a second region;

a second end portion connected to said second end of each of said side legs along a second fold line, said second end portion including a second intermediate fold line disposed at an oblique angle relative to said second fold line to divide said second end portion into a first region adjacent said second fold line and a second region;

a flexible film material connected to said panel so as to extend across said window opening; and a series of foldable members, ones of said foldable members being foldably connected at one edge to said side legs, and others of said foldable members being foldably connected at one edge to said end legs;

said folding side legs being folded against said rear surface of said panel with said first end portions secured in said second regions to one of said end legs and said second end portions secured in said second regions to another one of said end legs to define an intermediate folded structure in which said folding end legs are substantially coplanar with one another;

said panel being foldable from said intermediate folded structure to a use condition in which said side legs and said end legs project away from said rear surface of said panel.

* * * * *

UNITED STATES PATENT AND TRADEMARK OFFICE

CERTIFICATE OF CORRECTION

PATENT NO. : 6,302,274 B1
DATED : October 16, 2001
INVENTOR(S) : Devin C. Ridgeway It is certified that error appears in the above-identified patent and that said Letters Patent is hereby corrected as shown below:

Title page,
OTHER PUBLICATIONS, after "graphs 1-3, date unknown." Insert
-- [74] *Attorney, Agent*, or *Firm* - Lerner, David, Littenberg, Krumholz & Mentlik, LLP --.

Column 1,
Line 16, cancel the word "or".

Signed and Sealed this

Second Day of July, 2002

*Attest:*

*Attesting Officer*

JAMES E. ROGAN
*Director of the United States Patent and Trademark Office*